US007860616B2

(12) United States Patent
Ito et al.

(10) Patent No.: US 7,860,616 B2
(45) Date of Patent: Dec. 28, 2010

(54) REMOTE CONTROL SYSTEM FOR A WATERCRAFT

(75) Inventors: Makoto Ito, Shizuoka (JP); Takashi Okuyama, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 96 days.

(21) Appl. No.: 12/370,522

(22) Filed: Feb. 12, 2009

(65) Prior Publication Data

US 2010/0131132 A1 May 27, 2010

Related U.S. Application Data

(63) Continuation of application No. 11/731,691, filed on Mar. 30, 2007, now abandoned.

(30) Foreign Application Priority Data

Jun. 2, 2006 (JP) ..... 2006-154480

(51) Int. Cl.
*B63H 21/21* (2006.01)
*B60W 10/04* (2006.01)
*G06F 19/00* (2006.01)

(52) U.S. Cl. ..... 701/2; 701/21; 440/87

(58) Field of Classification Search ..... 701/2, 701/21, 33, 35; 440/87, 84, 61 T; 114/146, 114/144 RE
See application file for complete search history.

(56) References Cited

U.S. PATENT DOCUMENTS 6,416,368 B1 * 7/2002 Griffith et al. ..... 440/6
6,547,610 B2 * 4/2003 Kim ..... 440/5
2005/0282447 A1 * 12/2005 Okuyama ..... 440/53

* cited by examiner

*Primary Examiner*—Tan Q Nguyen
(74) *Attorney, Agent, or Firm*—Keating & Bennett, LLP

(57) ABSTRACT

A remote control system for controlling a propulsion unit of a watercraft includes a plurality of remote controller side ECUs, all of which have the same construction in one embodiment. Each remote controller side ECU includes ECU discriminating terminal sections and an ECU determining section for determining a role of each remote controller side ECU based upon signals provided by the ECU discriminating terminal sections. The ECU determining section determines a role of the particular remote controller side ECU based upon the signals provided by the ECU discriminating terminal sections when the remote controller side ECU starts operating. The ECU determining section also reads out the most proper one of first through sixth exclusive use sections, which define the function of the ECU's role. A determination result is stored in first, second and third EPROMs so as to be used to determine the role.

18 Claims, 9 Drawing Sheets

[FIG. 1]

[FIG. 5]
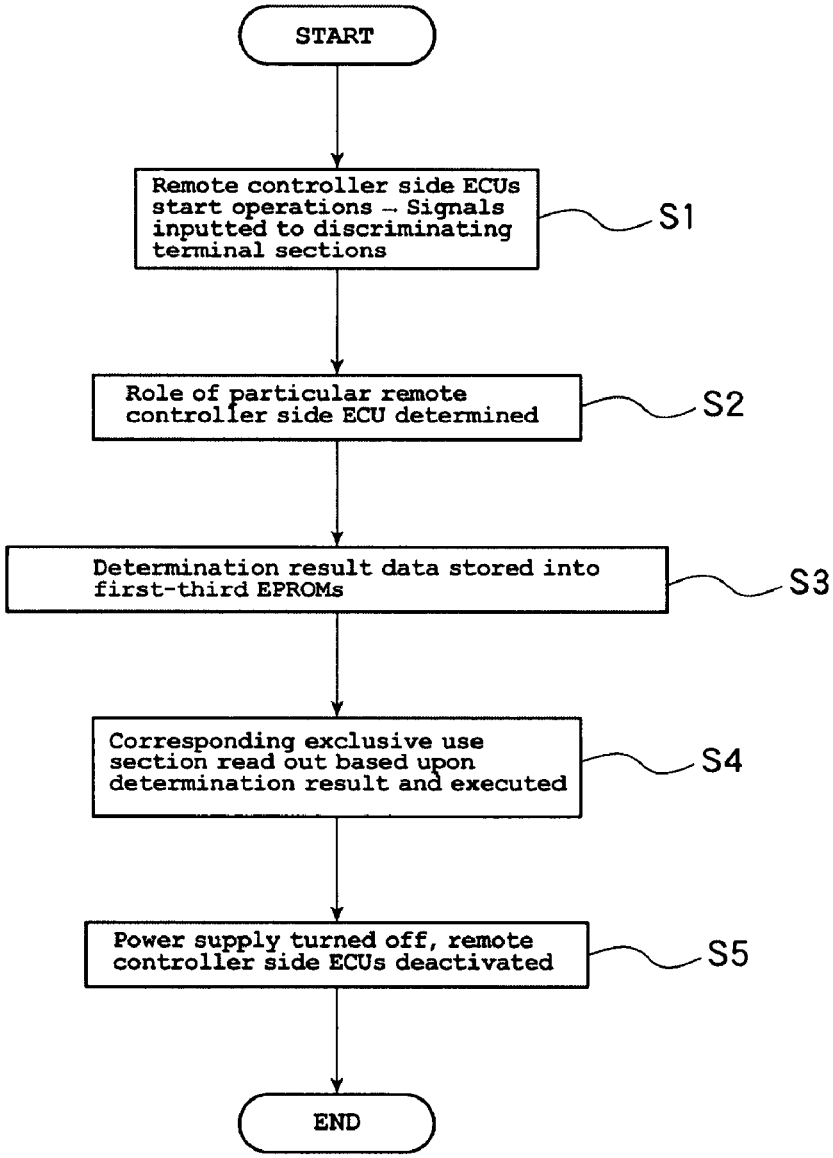

[FIG. 6]

| Signal 1 | Signal 2 | Signal 3 | ECU function |
|---|---|---|---|
| 1 | 0 | 0 | Main, for left outboard motor |
| 0 | 1 | 0 | Main, for central outboard motor |
| 0 | 0 | 1 | Main, for right outboard motor |
| 0 | 1 | 1 | Auxiliary, for left outboard motor |
| 1 | 0 | 1 | Auxiliary, for central outboard motor |
| 1 | 1 | 0 | Auxiliary, for right outboard motor |

REMOTE CONTROL SYSTEM FOR A WATERCRAFT

CROSS-REFERENCE TO RELATED APPLICATIONS

The present Application is a continuation application of U.S. patent application Ser. No. 11/731,691, filed Mar. 30, 2007, now abandoned, and is also based on and claims priority under 35 U.S.C. §119 to Japanese Patent Application Serial No. 2006-154480, filed on Jun. 2, 2006, the entire contents of which are expressly incorporated by reference herein.

BACKGROUND

1. Field

The present invention relates to a remote control system for controlling a marine propulsion unit of a boat at a position remote from the propulsion unit.

2. Description of the Related Art

A conventional watercraft has a remote controller having a shift lever for remotely controlling forward, neutral and reverse mode shift operations of an associated watercraft propulsion unit. The remote controller can have a control device for controlling an operational amount of the shift actuator based upon a degree of manipulation of the shift lever. Such an example watercraft is disclosed in Japanese Patent Document JP-A-2005-297785.

However, some watercrafts can have a plurality of cockpits and/or have a plurality of propulsion units, and a plurality of remote controller side electronic control units (ECUs) may be employed. Managing and maintaining such multiple ECUs can present challenges.

SUMMARY

Accordingly, there is a need in the art for a remote control system in which a plurality of remote control side ECUs, each having a different function, can effectively deal with problems that may arise in communication between the ECUs or other problems without hampering the operator's ability to control an associated propulsion unit via a remote controller.

In accordance with one embodiment, a remote control system is provided that has a plurality of remote controller side ECUs. The ECUs are each generally identical, but have different roles, such as controlling a specific propulsion device in connection with a specific remote controller. Each remote controller side ECU has an ECU discriminating terminal section that sends a signal to an ECU determining section. The ECU determining section is configured to read the signal and, based on the signal, determine a role of each remote controller side ECU. An exclusive use section, which has to do with the particular role of the ECU as determined by the determining section, is chosen based upon a signal provided by the ECU determining section.

Applicants have discovered that, in a system as set out immediately above, signals for assigning the respective remote controller side ECUs with predetermined roles may need to be supplied to the ECU discriminating terminal section continuously as long as the watercraft operates, leading to potential problems if an accident occurs such that a portion of or the whole of the wiring harness supplying the signals to the ECU discriminating terminal section malfunctions or is damaged.

In one embodiment, a remote controller system is provided having one type of remote controller side ECU that can be used for multiple propulsion units so that multiple remote controller side ECUs are arranged at every cockpit for controlling the propulsion units. The role of each ECU can be determined, for example, based on the associated propulsion unit and cockpit remote control. However, the ECUs are configured so that if communication of the role of the ECU is interrupted or cut off (due, for example, to malfunction or damage) during watercraft operation, the ECU will maintain operability and continue to control the associated propulsion unit.

In accordance with one embodiment, the present invention provides a remote control system for controlling a propulsion unit of a watercraft. The system comprises a plurality of remote controller side ECUs, each of which is configured to be able to perform a role of each of the other remote controller side ECUs. Each remote controller side ECU includes an ECU discriminating terminal section configured to receive a signal indicative of the role of the associated ECU, an ECU determining section configured to determine a role of the remote controller side ECU based upon the signal from the ECU discriminating terminal section, and an exclusive use section configured to operate based upon a signal provided by the ECU determining section to execute a function corresponding to the role that is assigned to the remote controller side ECU. The ECU determining section reads the signal from the ECU discriminating terminal section when the remote controller side ECU initially starts operation in order to make a role determination result that determines the role of the ECU. The ECU determining section controls the exclusive use section to continuously operate based upon the role determination result until the remote controller side ECU stops operating.

In another embodiment, the exclusive use section of each remote controller side ECU comprises a section having role instruction sets for each possible role of the plurality of remote controller side ECUs, and the role determination result chooses one of the role instruction sets for operation of the corresponding ECU. In a further embodiment, each of the plurality of remote controller side ECUs has substantially the same structure. In a yet further embodiment, each role determination result is a function of a remote controller portion to which the remote controller side ECU is coupled and propulsion unit which the remote controller side ECU controls.

In yet another embodiment, each remote controller side ECU further comprises an electronic storage device that is writable during operation of the remote controller side ECU, and wherein the storage device is configured to store a role determination result determined by the ECU determining section. In a further such embodiment, the ECU determining section is configured so that if the ECU determining section does not receive a readable signal from the ECU discriminating terminal section, the ECU determining section controls the exclusive use section to operate based upon the determined role stored in the storage device.

In another embodiment, the storage device comprises a plurality of memories. Each memory is configured to store the role determination result, and the ECU determining section reads the role determination results from the memories to compare the role determination results with each other. The ECU determining section determines which stored role determination result is most frequent, and controls the exclusive use section to operate on the most frequently stored role determination result.

In some embodiments, the ECU determining section is configured so that if all of the stored role determination results are different from each other, the ECU determining section controls the remote controller side ECU to function as if only a single propulsion unit were associated with the remote control system. In other embodiments, the plurality of remote controller side ECUs are adapted to communicate data concerning their corresponding propulsion units with one another. In further embodiments, the storage device comprises a first EPROM, a second EPROM, and a third EPROM.

In still another embodiment, the ECU determining section is configured so that if the ECU determining section does not receive a readable signal from the ECU discriminating terminal section, and if all of the stored role determination results are different from each other, the ECU determining section controls the remote controller side ECU to function as if only a single propulsion unit were associated with the remote control system.

In accordance with another embodiment of the present invention, a boat is provided having a first propulsion device and a second propulsion device. The boat comprises a main remote controller having a first remote controller side ECU and a second remote controller side ECU. A first ECU role is defined as a role of the remote controller side ECU adapted to control the first propulsion device and receive control inputs from the main remote controller, and a second ECU role is defined as a role of the remote controller side ECU adapted to control the second propulsion device and receive control inputs from the main remote controller. The first and second ECUs both are capable of performing the first and second ECU roles and having first and second role instruction sets stored therein. The first and second ECUs are further adapted to communicate data with each other concerning their corresponding propulsion devices. Each remote controller side ECU comprises an electronic storage device configured to store a role determination result adapted to determine which of the first and second role instruction sets will be chosen to direct operation of the respective ECU. Upon start of operation, a role determining section reads the stored role determination result and selects the appropriate instruction set, and the remote controller side ECU will operate based on the selected instruction set until the remote controller side ECU stops operating.

In some embodiments, the first and second remote controller side ECUs are adapted to control their corresponding propulsion units based upon inputs from the corresponding remote controller and data received concerning the propulsion unit corresponding to the other remote controller side ECU. In other embodiments, the remote controller side ECUs are adapted to receive a signal to indicate the role determination result, and the role determining section is adapted to read the received signal to determine the appropriate instruction set if the appropriate instruction set cannot be determined by reading the stored role determination result from the storage device. In still further embodiments, if the appropriate instruction set cannot be determined by reading the stored role determination result from the storage device and the signal to indicate the role determination result cannot be read, the remote controller side ECU is adapted to control the corresponding propulsion unit as if the boat has only one propulsion unit.

In additional embodiments, a method can be provided for operating a remote control system for controlling propulsion units of a watercraft, wherein the watercraft includes at least a main cockpit and at least a left side propulsion unit and a right side propulsion unit, first and second remote controller side ECUs disposed in the main cockpit, each of the ECUs including at least a central processing unit and plurality of programs stored in a memory, the plurality of programs including at least two exclusive use sections, a first exclusive use section providing a function corresponding to the role of the main cockpit and the left side propulsion unit, the second exclusive use section providing a function corresponding to the role of the main cockpit and the right side propulsion unit. The method can comprise activating the first ECU, receiving an input signal with the first ECU, determining which of the roles should be performed by the first ECU based on the input signal, and reading out the exclusive use section corresponding to the role determined in the determining step, from the plurality of programs in the memory. The method can also include executing the exclusive use section determined in the determining step with the central processing unit of the first ECU without executing any of the other exclusive use sections of the programs in the memory, so as to operate the first ECU in the role determined in the determining step.

In additional embodiments, a method can be provided for operating a remote control system for controlling at least one propulsion unit of a watercraft, wherein the watercraft includes at least one remote controller having at least a first ECU, the first ECU including a plurality of programs stored in a memory, the plurality of programs including at least two exclusive use sections, a first exclusive use section providing a function corresponding to the role of a main cockpit and at least one propulsion unit, the second exclusive use section providing a function corresponding to the role of an auxiliary cockpit and the at least one propulsion unit. The method can comprise activating the first ECU, receiving an input signal with the first ECU, determining which of the roles should be performed by the first ECU based on the input signal, reading out the exclusive use section corresponding to the role determined in the determining step, from the plurality of programs in the memory. Additionally, the method can also include executing the exclusive use section determined in the determining step with the first ECU without executing any of the other exclusive use sections of the programs in the memory, so as to operate the first ECU in the role determined in the determining step.

In other embodiments, a method can be provided for operating a remote control system for controlling at least one propulsion unit of a watercraft, wherein the watercraft includes at least one remote controller having at least a first ECU, the first ECU including a plurality of programs stored in a memory, the plurality of programs including at least two exclusive use sections, a first exclusive use section providing a function corresponding to the role of a first propulsion unit, the second exclusive use section providing a function corresponding to the role of a second propulsion unit. The method can comprise activating the first ECU, receiving an input signal with the first ECU, determining which of the roles should be performed by the first ECU based on the input signal, storing the role determined in the determining step, repeating the activating, receiving, determining and storing steps a plurality of times, and determining which of the roles are stored most frequently. Additionally, the method can comprise executing with the first ECU the exclusive use section that corresponds to the role that is determined as being stored most frequently, without executing any of the other exclusive use sections of the programs in the memory.

BRIEF DESCRIPTION OF THE DRAWINGS

FIG. 5 is a flowchart showing processes of an operation of the remote controller side ECU of the embodiment on the first execution of the routine.

FIG. 6 is a table showing signals and ECU functions of the embodiment.

DETAILED DESCRIPTION OF EMBODIMENTS

Figure 1:
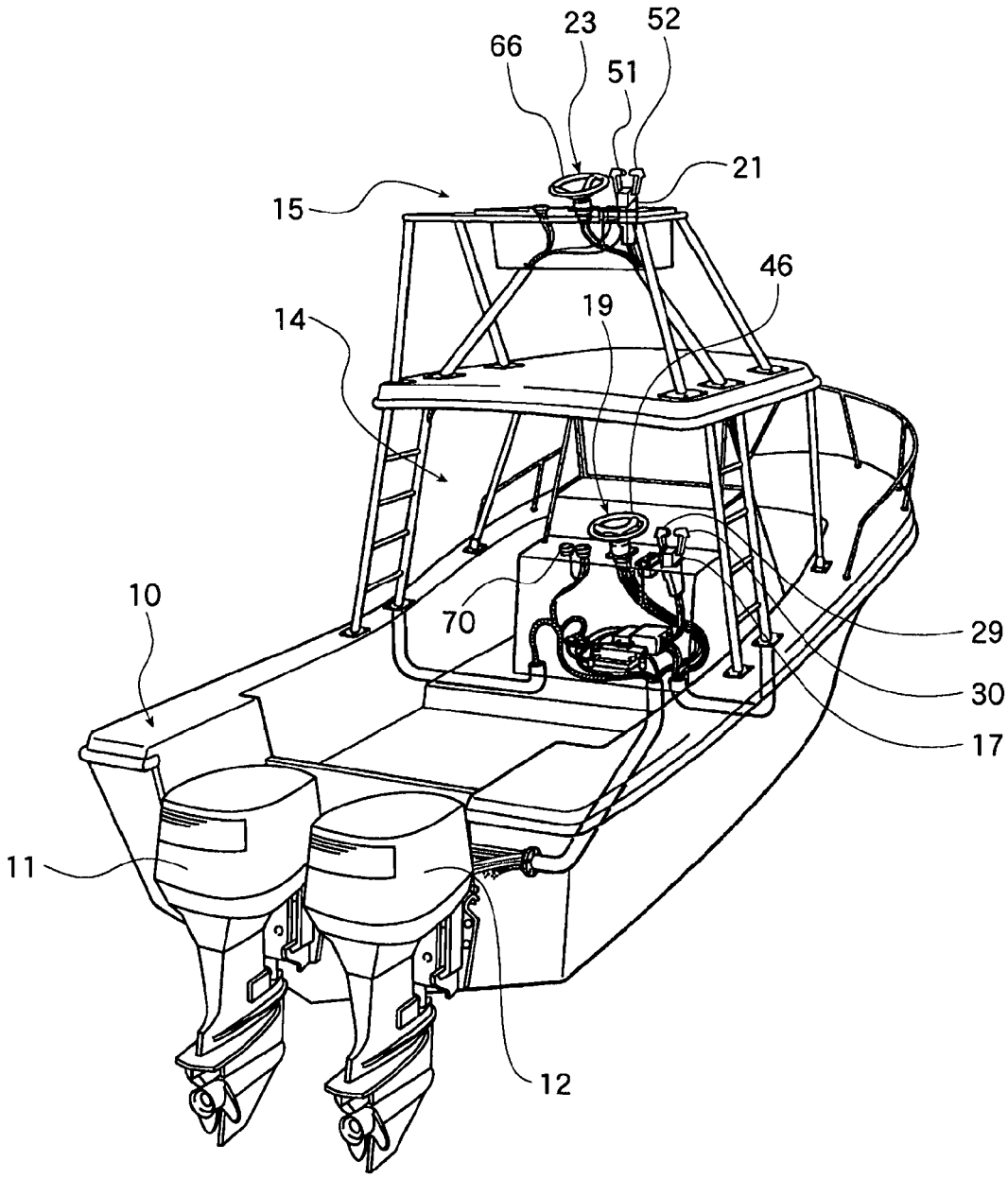
FIG. 1 is a perspective view of a watercraft configured in accordance with an embodiment of the invention, viewed from an obliquely rearward location.

First, with reference to FIGS. 1 and 2, a structure of an embodiment of a watercraft will be described. Two outboard motors 11, 12 functioning as the "watercraft propulsion unit" are mounted to a stern of a hull 10 of the watercraft. The watercraft hull 10 has two cockpits (a main cockpit 14 and an auxiliary cockpit 15). The main cockpit 14 has a main cockpit side remote controller 17, a key switch device 18, a steering wheel unit 19 and so forth, while the auxiliary cockpit 15 has an auxiliary cockpit side remote controller 21, a key switch device 22, a steering wheel unit 23 and so forth. With those devices and units, the outboard motors 11, 12 can be controlled. It is to be understood that other types of propulsion units, such as stern drives and inboard drives, are contemplated.

Figure 3:
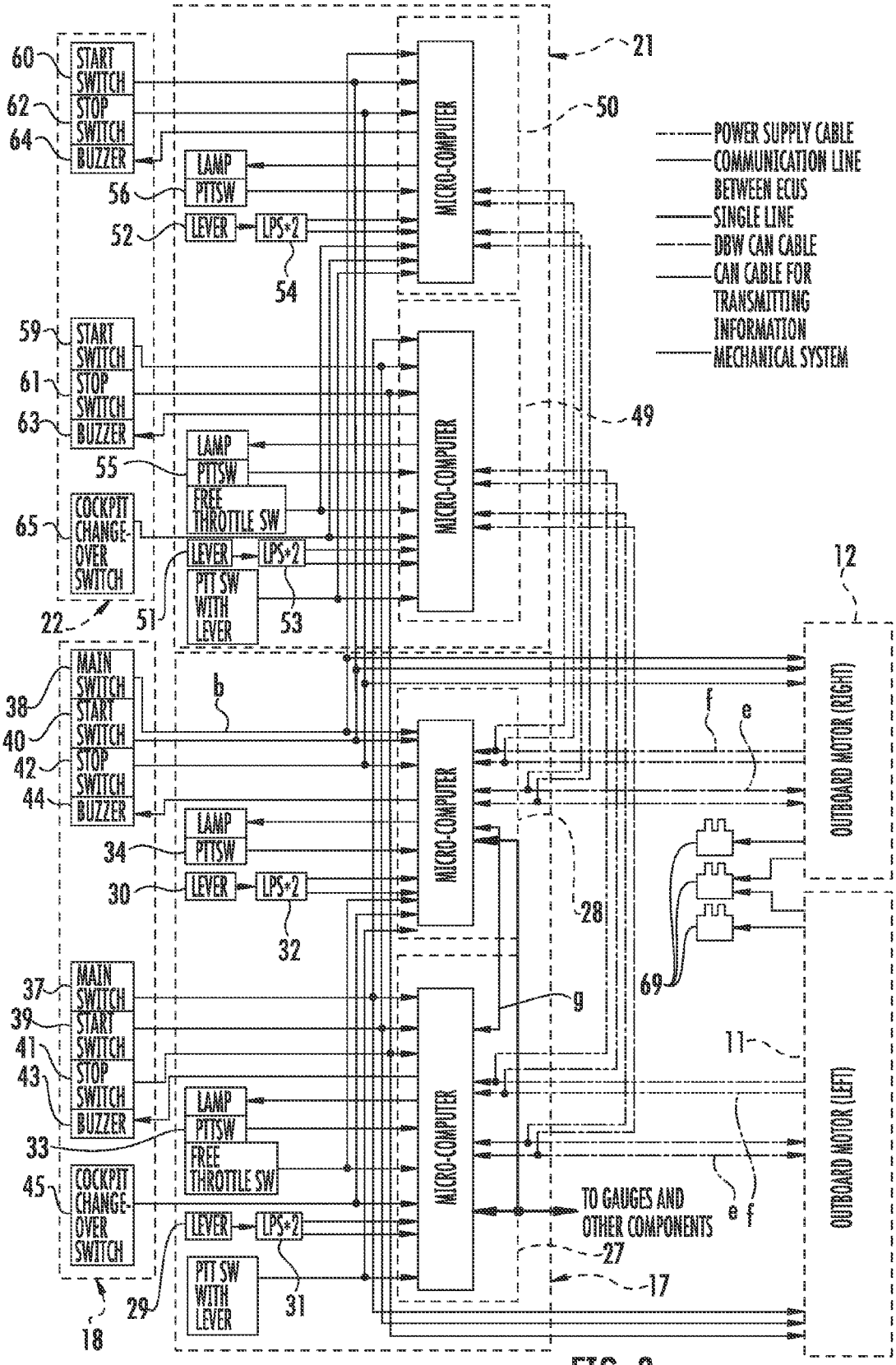
FIG. 3 is a block diagram showing connecting conditions of the remote controllers, key switches, outboard motors and other components connected each other in the watercraft of the embodiment.

As shown in FIG. 3, the main cockpit side remote controller 17 of the main cockpit 14 preferably has a left unit controlling main remote controller side ECU 27 for controlling the outboard motor 11 positioned on the left side and a right unit controlling main remote controller side ECU 28 for controlling the outboard motor 12 positioned on the right side, both of which are built in a remote controller body 26. Also, the remote controller 17 has a pair of remote control levers 29, 30 each for manipulating a throttle valve unit and a shift unit, and has position sensors 31, 32 for detecting positions of the respective control levers 29, 30. The respective position sensors 31, 32 are connected to the respective remote controller side ECUs 27, 28 through two signal lines b provided for each combination. Also, PTT (power trim and tilt) switches 33, 34 are connected to the respective remote controller side ECUs 27, 28 through signal lines b.

The key switch device 18 is connected to the left and right unit controlling main remote controller side ECUs 27, 28. The key switch device 18 preferably has two sets of components each including a main switch 37, 38, a starting switch 39, 40, a stop switch 41, 42 and a buzzer 43, 44 corresponding to the respective main remote controller side ECU 27, 28. The key switch device 18 is connected to the respective main remote controller side ECUs 27, 28 through signal lines b.

The steering wheel unit 19 of the main cockpit 14 preferably has a steering wheel unit side ECU which is built in and not shown, and has a steering wheel 46 for steering the watercraft. A position sensor detects a rotational position (rotational angular position) of the steering wheel 46. The position sensor is connected to the steering wheel unit side ECU through a signal line.

The steering wheel unit side ECU is connected to the respective remote controller side ECUs 27, 28 through DBW CAN cables functioning as signal lines. The term DBW stands for "Drive-By-Wire" and means an operating device in which electrical connections replace mechanical connections. The term CAN stands for "Controller Area Network."

With reference to FIG. 3, similarly to the structure of the main cockpit side 14 discussed above, the auxiliary cockpit side remote controller 21 of the auxiliary cockpit 15 preferably has a left unit controlling auxiliary remote controller side ECU 49 for controlling the outboard motor 11 positioned on the left side and a right unit controlling auxiliary remote controller side ECU 50 for controlling the outboard motor 12 positioned on the right side, both of which are built in a remote controller body 48. Also, the remote controller 21 has a pair of remote control levers 51, 52 each for manipulating a throttle valve unit and a shift unit, and has position sensors 53, 54 for detecting positions of the respective control levers 51, 52. The respective position sensors 53, 54 are connected to the respective remote controller side ECUs 49, 50 through two signal lines b provided for each combination. Also, PTT (power trim and tilt) switches 55, 56 are connected to the respective remote controller side ECUs 49, 50 through signal lines b.

The key switch device 22 preferably is connected to the left and right unit controlling auxiliary remote controller side ECUs 49, 50. The key switch device 22 has two sets of components each including a start switch 59, 60, a stop switch 61, 62 and a buzzer 63, 64 corresponding to the respective auxiliary remote controller side ECU 49, 50. The key switch device 22 is connected to the respective auxiliary remote controller side ECUs 49, 50 through signal lines b.

The steering wheel unit 23 of the auxiliary cockpit 15 preferably has a steering wheel unit side ECU which is built in and not shown, and has a steering wheel 66 for steering the watercraft. A position sensor detects a position of the steering wheel 66. The position sensor is connected to the steering wheel unit side ECU through a signal line.

In the illustrated embodiment, the left unit controlling main remote controller side ECU 27 is connected to an engine side ECU, which is not shown, disposed on the left outboard motor 11 through power supply cables f and DBW CAN cables e. The right unit controlling main remote controller side ECU 28 is connected to an engine side ECU, which is not shown, disposed on the right outboard motor 12 through power supply cables f and DBW CAN cables e. Three batteries 69 in total preferably are connected to the outboard motors 11, 12. The batteries 69 are connected to the left unit controlling main remote controller side ECU 27 and the right unit controlling main remote controller side ECU 28 through the power supply cables f However, other structure is possible. For example, there can be more, or fewer, batteries connected to the outboard motors 11, 12.

Each engine side ECU preferably properly controls engine operational conditions including a fuel injection amount, an injection time and an ignition time based upon a throttle valve opening provided by a throttle valve opening sensor, an engine speed provided by a crankshaft angle sensor and detection amounts provided by other sensors.

Various detection amounts (operational information) including the throttle valve opening and the engine speed preferably are transmitted from the respective engine side ECUs to the corresponding main remote controller side ECUs 27, 28 through the DBW CAN cables e. Such operational information is transmitted and received between the respective main remote controller side ECUs 27, 28 through ECU communication lines g.

The engine side ECUs of the respective outboard motors 11, 12 preferably are controlled based upon the control signals provided by the respective main remote control side ECUs 27, 28. That is, the fuel injection amount, the injection time, the ignition time, etc. preferably are controlled so that a difference between the engine speeds of the respective outboard motors 11, 12 can be within a target range.

The respective auxiliary remote controller side ECUs 49, 50 preferably are connected to the respective main remote controller side ECUs 27, 28. More specifically, the left unit auxiliary remote controller side ECU 49 is connected to the left unit main remote controller side ECU 27 through the DBW CAN cables e and the power supply cables f, while the right unit auxiliary remote controller side ECU 50 is connected to the right unit main remote controller side ECU 28 through the DBW CAN cables e and the power supply cables f.

Figure 2:
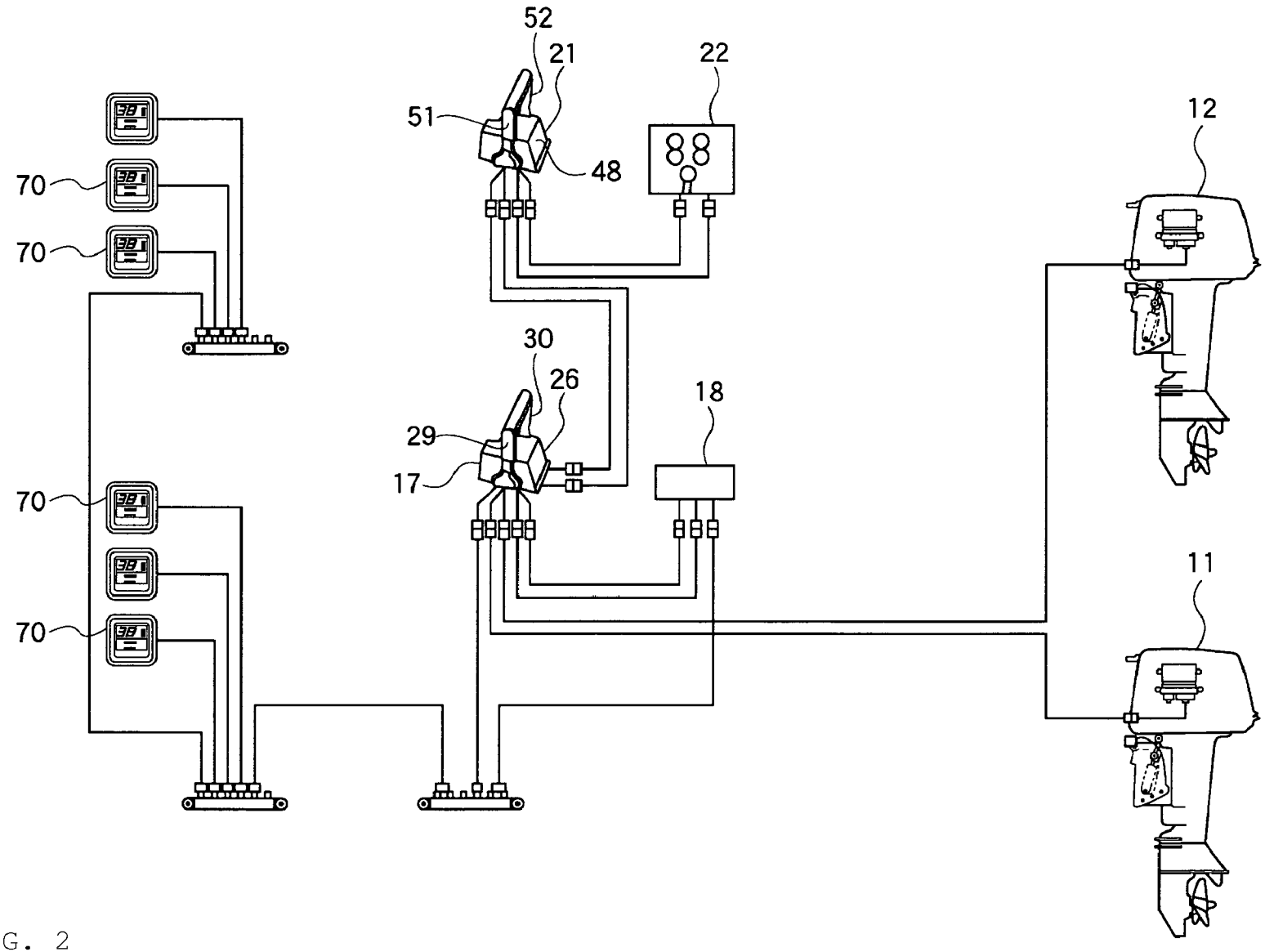
FIG. 2 is a schematic block diagram showing connecting conditions of remote controllers, outboard motors and other components connected with each other in the watercraft of the embodiment.

As shown in FIG. 2, gauges 70 preferably communicate with the ECUs 27, 28.

Figure 4:
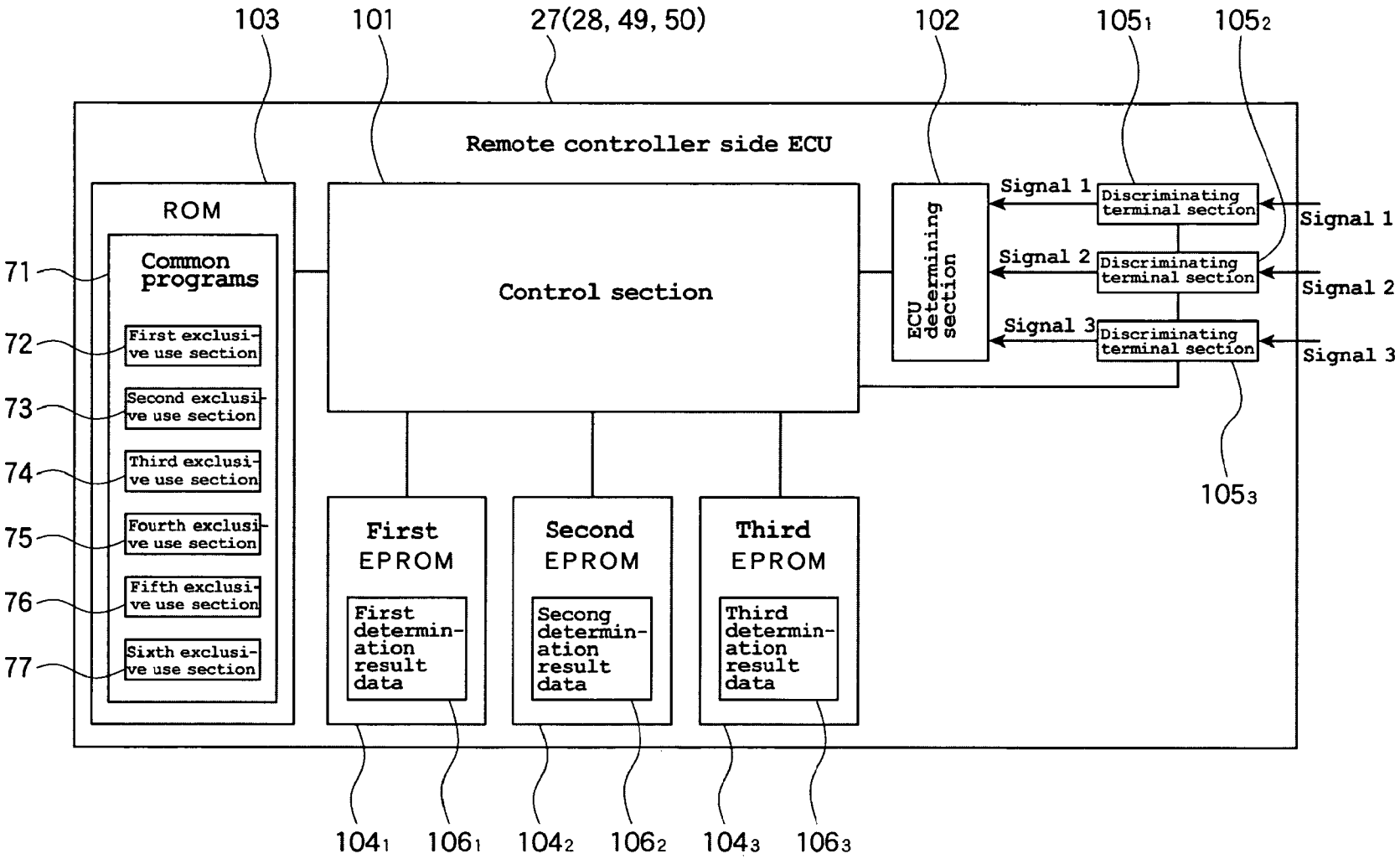
FIG. 4 is a block diagram showing a remote controller side ECU of the embodiment.

The remote controller side ECUs 27, 28, 49, 50 can be positioned at multiple cockpits and can control multiple outboard motors. In one preferred embodiment, the respective remote controller side ECUs 27, 28, 49, 50 have generally the same construction. FIG. 4 is a block diagram showing functions of the respective remote controller side ECUs 27, 28, 49, 50 in this embodiment. As shown in FIG. 4, each remote controller side ECU 27, 28, 49, 50 has a control section 101, an ECU determining section 102, a ROM (read only memory) 103, and a first EPROM (erasable programmable read only memory) $\mathbf{104}_1$, a second EPROM $\mathbf{104}_2$, a third EPROM $\mathbf{104}_3$ all of which function as part of storing device. Each remote controller side ECU 27, 28, 49, 50 also has ECU discriminating terminal sections $\mathbf{105}_1$, $\mathbf{105}_2$, $\mathbf{105}_3$. Functions shown in FIG. 4 can be realized by, in addition to the first EPROM $\mathbf{104}_1$, the second EPROM $\mathbf{104}_2$ and the third EPROM $\mathbf{104}_3$, hardware including, although not shown, at least a CPU (central processing unit), a RAM (random access memory) and I/O (input/output) ports which are connected through a bus connection, and various programs which are stored in the ROM 103, the respective EPROMs $\mathbf{104}_1$, $\mathbf{104}_2$, $\mathbf{104}_3$ or the like and which work together with the hardware.

The control section 101 includes the CPU (not shown) to at least execute calculation processes of the respective programs and to control the whole of the processes executed by the remote controller side ECU 27, 28, 49, 50. The CPU (not shown) executes the calculation processes or the like using the ROM (not shown) as a working area.

Each ECU discriminating terminal section $\mathbf{105}_1$, $\mathbf{105}_2$, $\mathbf{105}_3$ includes the I/O ports (not shown), a grounded wiring and lead wirings to execute necessary processes for inputting/outputting signals used in the ECU determining section 102 and also for discriminating types of the signals. That is, the three ECU discriminating terminal sections $\mathbf{105}_1$, $\mathbf{105}_2$, $\mathbf{105}_3$ can output different signals by being grounded or being connected to the power supply cable f in response to outputs provided by the respective remote controller side ECUs 27, 28, 49, 50. Thus, when signals 1, 2, and 3 are inputted to the ECU determining section 102 from the respective ECU discriminating terminal sections $\mathbf{105}_1$, $\mathbf{105}_2$, $\mathbf{105}_3$, a role assigned to the particular remote controller side ECU 27, 28, 49, 50 can be determined.

The ECU determining section 102 determines which role is assigned to the remote controller side ECU 27, 28, 49, 50 that associates with the ECU determining section 102 based upon the signals provided by the ECU discriminating terminal sections $\mathbf{105}_1$, $\mathbf{105}_2$, $\mathbf{105}_3$ and the data stored in the first EPROM $\mathbf{104}_1$, the second EPROM $\mathbf{104}_2$ and the third EPROM $\mathbf{104}_3$.

The ROM 103 is a non-volatile memory that allows data to be written once therein and stores common programs 71. The common programs 71 are executed by the CPU (not shown) of the control section 101 to make the particular remote controller side ECU 27, 28, 49, 50 function as an ECU that achieves a role which is assigned thereto. The common programs 71 are formed with first through six exclusive use sections 72, 73, 74, 75, 76, 77. The first exclusive use section 72 is provided for executing a function corresponding to a specific role for the main cockpit 14 and for the left outboard motor 11. Similarly, the second exclusive use section 73 is provided for executing a function corresponding to a specific role for the main cockpit 14 and for a central outboard motor (not provided in this embodiment). The third exclusive use section 74 is provided for executing a function corresponding to a specific role for the main cockpit 14 and for the right outboard motor 12. The fourth exclusive use section 75 is provided for executing a function corresponding to a specific role for the auxiliary cockpit 15 and for the left outboard motor 11. The fifth exclusive use section 76 is provided for executing a function corresponding to the auxiliary cockpit 15 and for the central outboard motor (not provided in this embodiment). The sixth exclusive use section 77 is provided for executing a function corresponding to the auxiliary cockpit 15 and for the right outboard motor 12.

The first EPROM $\mathbf{104}_1$, the second EPROM $\mathbf{104}_2$ and the third EPROM $\mathbf{104}_3$ are ROMs in which stored data can be erased and new data can be written. The EPROMs $\mathbf{104}_1$, $\mathbf{104}_2$, $\mathbf{104}_3$ store first determination result data $\mathbf{106}_1$, second determination result data $\mathbf{106}_2$ and third determination result data $\mathbf{106}_3$, respectively, as a result of the determination (described later) made by the associated ECU determination section 102. The first, second and third determination result data $\mathbf{106}_1$, $\mathbf{106}_2$, $\mathbf{106}_3$ are used for reading the first through sixth exclusive use sections 72-77 (described later).

Next, according to this embodiment, an operation of each remote controller side ECU 27, 28, 49, 50 will be described below.

FIG. 5 is a flowchart showing processes of the operation of the remote controller side ECU 27, 28, 49, 50 according to this embodiment on the first execution of the routine. As shown in FIG. 5, first, when the main switches 37, 38 are turned on to start the respective remote controller side ECUs 27, 28, 49, 50, the signals 1, 2, 3 are inputted to the three ECU discriminating terminal sections $\mathbf{105}_1$, $\mathbf{105}_2$, $\mathbf{105}_3$ in each remote controller side ECU 27, 28, 49, 50 (step S1). The signals 1, 2, 3 are inputted to the associated ECU determining section 102 through the respective ECU discriminating terminal sections $\mathbf{105}_1$, $\mathbf{105}_2$, $\mathbf{105}_3$. Input ports of the ECU determining section 102 receive the signals 1, 2, 3 and the ECU determining section 102 recognizes that a signal whose level is lower than a preset threshold designates "0" and another signal whose level is higher than the threshold designates "1." Specifically, a signal inputted into the ECU determining section 102 through any one of the ECU discriminating terminal sections $\mathbf{105}_1$, $\mathbf{105}_2$, $\mathbf{105}_3$ which are grounded is recognized as designating "0," while another signal inputted into the ECU determining section 102 through any one of the ECU discriminating terminal sections $\mathbf{105}_1$, $\mathbf{105}_2$, $\mathbf{105}_3$ which are connected to the power supply cable f is recognized as designating "1." The ECU determining section 102 determines which role is assigned to the particular remote controller side ECU 27, 28, 49, 50 based upon the recognition results (step S2).

For example, as shown in FIG. 6, if a recognition result of the remote controller side ECU 27 is that the signal 1 provided by the first ECU discriminating terminal section $\mathbf{105}_1$ designates "1," the signal 2 provided by the second ECU discriminating terminal section $\mathbf{105}_2$ designates "0," and the signal 3 provided by the third ECU discriminating terminal section $\mathbf{105}_3$ designates "0," the ECU determining section 102 determines that the particular ECU is the left unit controlling main remote controller side ECU 27 which is assigned the role for the left outboard motor 11 and for the main cockpit 14.

Also, if a recognition result of the remote controller side ECU 50 is that the signal 1 provided by the first ECU discriminating terminal section $\mathbf{105}_1$ designates "1," the signal 2 provided by the second ECU discriminating terminal section $\mathbf{105}_2$ designates "1," and the signal 1 provided by the third ECU discriminating terminal section $\mathbf{105}_3$ designates "0," the ECU determining section 102 determines that the particular ECU is the right unit controlling auxiliary remote controller side ECU 50 which is assigned the role for the right outboard motor 12 and for the auxiliary cockpit 15.

The roles of the other exclusive use remote controller side ECUs 28, 49 are determined in a similar manner. Additionally, because two outboard motors are provided to the watercraft in this embodiment, no remote controller side ECUs corresponding to the central outboard motor exist.

The determination result of the role made by each ECU determining section 102 is stored in the associated first EPROM $\mathbf{104}_1$, second EPROM $\mathbf{104}_2$ and third EPROM $\mathbf{104}_3$ as a first determination result data $\mathbf{106}_1$, a second determination result data $\mathbf{106}_2$ and a third determination result data $\mathbf{106}_3$, respectively (step S3).

In a preferred embodiment, the particular remote controller side ECU 27, 28, 49, 50 reads out corresponding one of the first through sixth exclusive use sections 72-77 based upon the determination result from the ROM 103. The remote controller side ECU 27, 28, 49, 50, then, executes the read-out exclusive use section by the CPU (not shown) of the control section 101 to realize the function of this exclusive use section (i.e., to function as the role of the exclusive use section) (step S4). For example, if the particular ECU is determined to be the left unit controlling main remote controller side ECU 27, the first exclusive use section 72 is read out and executed. Also, for example, if the particular ECU is determined to be the right unit controlling auxiliary remote controller side ECU 50, the sixth exclusive use section 78 is read out and executed.

The respective remote controller side ECUs 27, 28, 49, 50 preferably continue to function based upon the first through sixth exclusive use sections 72-77 read out in the step S4 until the main switches 37, 38 are turned off so as to deactivate those respective remote controller side ECUs 27, 28, 49, 50 (step S5).

The function of the respective remote controller side ECUs 27, 28, 49, 50 are different from each other depending whether the roles for the main cockpit or for the auxiliary cockpit. For example, in the illustrated embodiment, if the particular ECU works as the left or right unit controlling main remote controller side ECU 27, 28, the ECU 27, 28 exchanges the functions of the main cockpit 14 and the auxiliary cockpit 15 for each other. If, however, the particular ECU is works as the left or right unit controlling auxiliary remote controller side ECU 49, 50, the ECU 49, 50 does not make such exchanges. On the other hand, if the particular ECU works as the left or right unit controlling auxiliary remote controller side ECU 49, 50, the ECU 49, 50 transmits command amount signals to the main remote controller side ECUs 27, 28. If, however, the particular ECU works as the left or right unit controlling main remote controller side ECU 27, 28, the ECU 27, 28 does not transmit any command amount signals to the left or right unit controlling auxiliary remote controller side ECUs 49, 50.

Figure 7:
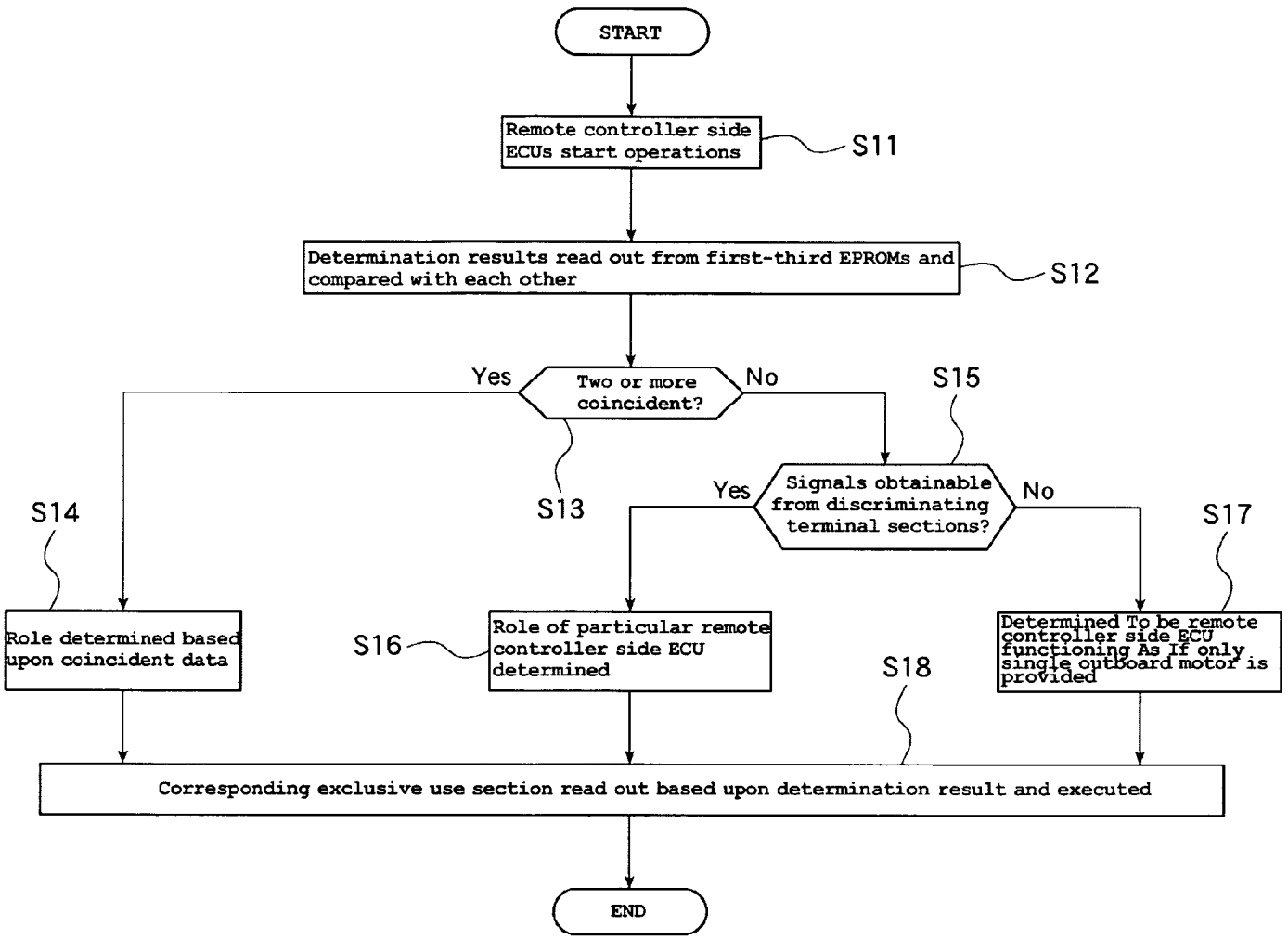
FIG. 7 is a flowchart showing processes of an operation of the remote controller side ECU of the embodiment on the second or later executions of the routine.

FIG. 7 is another flowchart showing processes of the operation of the remote controller side ECU 27, 28, 49, 50 on the second or later executions of the routine. As shown in FIG. 7, when the main switches 37, 38 are turned on to start the respective remote controller side ECUs 27, 28, 49, 50 (step S11), the ECU determining section 102 of each remote controller side ECUs 27, 28, 49, 50 reads out the first, second and third determination result data stored in the first, second and third EPROMs $\mathbf{104}_1$, $\mathbf{104}_2$, $\mathbf{104}_3$ to compare with each other (step S12).

As a result of the comparison, if two sets of the data are coincident with each other ("Yes" in the step S13), the ECU determining section 102 determines which role is assigned to the particular remote controller side ECU 27, 28, 49, 50 based upon the coincident data (step S14). For example, if all of the first, second and third determination result data $\mathbf{106}_1$, $\mathbf{106}_2$, $\mathbf{106}_3$ designate the left unit controlling main remote controller side ECU 27, or if the first and second determination result data $\mathbf{106}_1$, $\mathbf{106}_2$ designate the left unit controlling main remote controller side ECU 27 and the third determination result data $\mathbf{106}_3$ designates the right unit controlling auxiliary remote controller side ECU 50, the ECU determining section 102 determines that the particular ECU is assigned with the function corresponding to the predetermined role for the main cockpit 14 and for the left outboard motor 11.

The ECU determining section 102 compares the first, second and third determination result data $\mathbf{106}_1$, $\mathbf{106}_2$, $\mathbf{106}_3$ with each other and makes one of the exclusive use sections operate based upon the most frequently appearing data of the determination. Therefore, even if a portion of the first, second and third determination result data $\mathbf{106}_1$, $\mathbf{106}_2$, $\mathbf{106}_3$ is damaged, the most proper one of the first through sixth exclusive use sections 72-77 can be operated based upon the normal data.

Meanwhile, as a result of the comparison, if none of the data is coincident with one another ("No" in the step S13), the ECU determining section 102 examines whether new signals 1, 2, 3 are obtainable or not from the ECU discriminating terminal sections $\mathbf{105}_1$, $\mathbf{105}_2$, $\mathbf{105}_3$. If the signals 1, 2, 3 are obtainable ("Yes" in the step S15), the ECU determining section 102 obtains those signals 1, 2, 3 and recognizes a new code designated by the signals to determine which role is assigned to the particular remote controller side ECU 27, 28, 49, 50 based upon the recognition result (step S16). Therefore, even if the ECU determining section 102 is not able to determine the role based upon the first, second and third determination result data $\mathbf{106}_1$, $\mathbf{106}_2$, $\mathbf{106}_3$, the most proper one of the first through sixth exclusive use sections 72-77 can be operated based upon the signals 1, 2, 3 obtained from the ECU discriminating terminal sections $\mathbf{105}_1$, $\mathbf{105}_2$, $\mathbf{105}_3$. The watercraft thus can continue to operate. Additionally, the recognition result based upon the signals 1, 2, 3 which are newly obtained is stored in the first, second and third EPROMs $\mathbf{104}_1$, $\mathbf{104}_2$, $\mathbf{104}_3$ again as new first, second and third determination result data $\mathbf{106}_1$, $\mathbf{106}_2$, $\mathbf{106}_3$.

If none of the data is coincident with one another ("No" in the step S13) and the signals 1, 2, 3 are not obtainable from the ECU discriminating terminal sections $\mathbf{105}_1$, $\mathbf{105}_2$, $\mathbf{105}_3$ ("No" in the step S15), the ECU determining section 102 determines that the particular remote controller side ECU 27, 28, 49, 50 functions as a remote controller side ECU as if only a single outboard motor is provided (step S17). The particular remote controller side ECU 27, 28, 49, 50 thus controls the engine (not shown) of the associated outboard motor 11, 12 to operate as if the boat has only a single outboard motor.

For example, if a watercraft has two outboard motors 11, 12 as in the illustrated embodiment (or has three or more outboard motors), and if each ECU 27, 28, 49, 50 has a proper exclusive use section 72-77, the operational conditions of the engines (not shown) of the respective outboard motors 11, 12 are mutually adjusted so that the combination of the operational conditions is optimized for operating the boat. That is, the left and right unit controlling main remote controller side ECUs 27, 28 or the left and right unit controlling auxiliary remote controller side ECUs 49, 50 mutually exchange control signals to adjust control items and amounts of the counterpart (for example, the throttle valve opening adjustment whereby the throttle valve opening amounts of the respective engines (not shown) are generally the same as one another). However, if the ECU determining section 102 is not able to determine which role is assigned to the particular remote controller side ECU 27, 28, 49, 50 and the particular remote controller side ECU 27, 28, 49, 50 functions as the remote controller side ECU as if only a single outboard motor is provided, the respective outboard motors 11, 12 independently operate. That is, the operations of the respective outboard motors 11, 12 are not mutually adjusted. In other words, the left and right unit controlling main remote controller side ECUs 27, 28 or the left and right unit controlling auxiliary remote controller side ECUs 49, 50 do not mutually exchange control signals and the respective outboard motors 11, 12 operate independently.

As such, even if due to a fault, disconnection or the like, the ECU determining section 102 has no way to obtain information for identifying one of the first through sixth exclusive use sections 72-77 that functions most properly, the particular remote controller side ECU 27, 28, 49, 50 can still function sufficient to control the associated propulsion unit so that the watercraft can continue operating.

Thus, the particular remote controller side ECU 27, 28, 49, 50 reads out the most proper one of the first through sixth exclusive use sections 72-77 from the ROM 103 based upon the determination results obtained in the steps S14, S16, S17 to realize the function of the most proper exclusive use section (step S18).

The respective remote controller side ECUs 27, 28, 49, 50 continue to function based upon one of the first through sixth exclusive use sections 72-77 read out in the step S18 until the main switches 37, 38 are turned off so as to deactivate those respective remote controller side ECUs 27, 28, 49, 50 (step S19).

Because the respective remote controller side ECUs 27, 28, 49, 50 have the same construction in this embodiment, the number of types of the remote controller side ECUs 27, 28, 49, 50 can decrease and easiness for management and maintenance can be enhanced.

In a preferred embodiment, each role of the remote controller side ECU 27, 28, 49, 50 is determined before the watercraft starts to sail, and the remote controller side ECU 27, 28, 49, 50 executes the determined role during operation. Therefore, even if an accident occurs such that a portion or the whole of the wiring harness supplying the signals to the ECU discriminating terminal sections $\mathbf{105}_1$, $\mathbf{105}_2$, $\mathbf{105}_3$ breaks during watercraft operation, such incident will not necessarily cause the ECU determining section 102 to make errors, cease operation, or the like.

Also, in the embodiment, as long as the first, second and third determination result data $\mathbf{106}_1$, $\mathbf{106}_2$, $\mathbf{106}_3$ are stored in the first, second and third EPROMs $\mathbf{104}_1$, $\mathbf{104}_2$, $\mathbf{104}_3$, the most proper one of the first through sixth exclusive use sections 72-77 can be operated based upon the data stored in the first, second and third EPROMs $\mathbf{104}_1$, $\mathbf{104}_2$, $\mathbf{104}_3$, regardless of any input signals provided by the ECU discriminating terminal sections $\mathbf{105}_1$, $\mathbf{105}_2$, $\mathbf{105}_3$.

Figure 8:
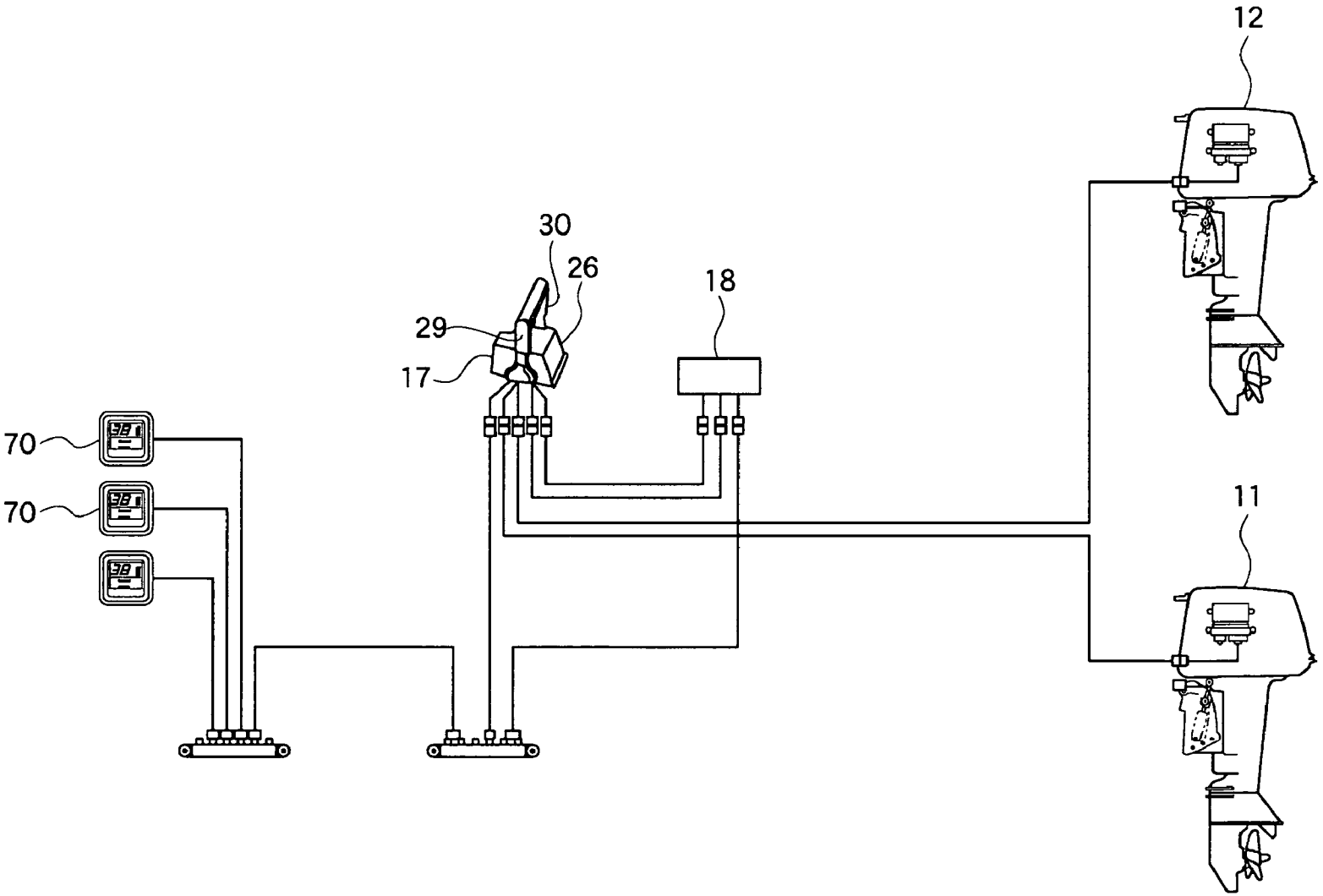
FIG. 8 is a schematic block diagram which is similar to FIG. 2, showing a modified watercraft having two outboard motors and one cockpit.
Figure 9:
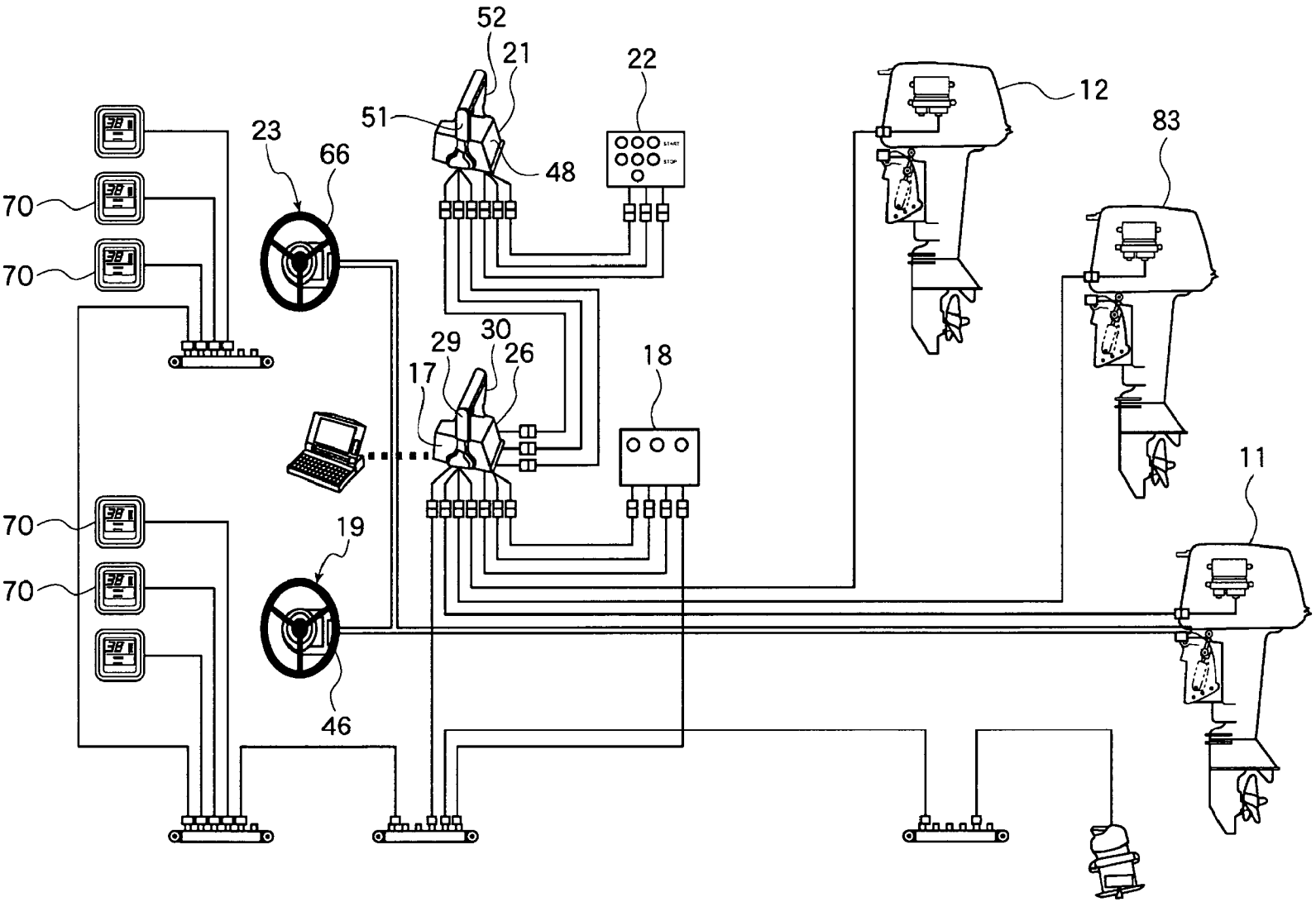
FIG. 9 is a schematic block diagram which is similar to FIG. 2, showing another modified watercraft having three outboard motors and two cockpits.

In the embodiments discussed above in connection with FIGS. 1-7, the remote controller side ECUs 27, 28, 49, 50 are applied to a boat having the two outboard motors and the two cockpits. Alternatively, such remote controller side ECUs can be applied to a boat having one outboard motor and one cockpit, to a watercraft having two outboard motors and one cockpit as shown in FIG. 8, and to a watercraft having three outboard motors and two cockpits as shown in FIG. 9. It is to be understood, however, that principles as discussed herein can be applied to various combinations of propulsion unit and cockpit setups such as more than three propulsion units, one, two, three or more cockpits, and the like.

As shown in FIG. 9, if a central outboard motor 83 is provided in addition to the right and left outboard motors 12, 11, two remote controller side ECUs (not shown) are provided for controlling the central outboard motor 83 other than the remote controller side ECUs 27, 49 for the left outboard motor 11 and the remote controller side ECUs 28, 50 for the right outboard motor 12. The respective, added remote controller side ECUs function as a central unit controlling main remote controller side ECU having the ROM storing the second exclusive use section 73 and also as a central unit controlling auxiliary remote controller side ECU having the ROM storing the fifth exclusive use section 76.

In the embodiment illustrated in connection with FIG. 9, the roles of the respective remote controller side ECUs are different from each other depending whether the remote controller side ECU is for the right, left or central outboard motor in addition to whether that ECU is for the main cockpit or the auxiliary cockpit. For example, the left and right unit-controlling main remote controller side ECUs 27, 28 and the central unit-controlling main remote controller side ECU execute shift mode/throttle valve opening change processes based upon detection signals provided by the position sensors 31, 32 and so forth. On such occasions, the left and right unit controlling main remote controller side ECUs 27, 28 transmit command amount signals to the right and left outboard motors 12, 11 following the shift mode/throttle valve opening change processes. However, the central unit controlling main remote controller side ECU (not shown) preferably controls the shift modes and the throttle valve openings of the central outboard motor 83 to target a middle position between the remote control levers 29, 30 or the remote control levers 51, 52.

In the watercraft having three outboard motors as shown in FIG. 9, if the respective remote controller side ECUs 27, 28, 49, 50 are determined to function as remote controller side ECUs as if only a single outboard motor is provided (step S17 of FIG. 7) and the outboard motors 11, 12, 83 are controlled as if each of them is provided as a single outboard motor, a control which is different from the control provided for the watercraft having two outboard motors shown in FIG. 1 etc. is provided in accordance with the number of the outboard motors.

For example, under the normal operating condition in accordance with one embodiment, the central unit controlling main remote controller side ECU (not shown) adjusts control items and amounts of the engine (not shown) for the central outboard motor to target a middle position between the remote control levers 29, 30 or the remote control levers 51, 52 (for example, the remote controller side ECU adjusts an engine speed of the engine for the central outboard motor to be a mean value existing between an engine speed of an engine for the right outboard motor and an engine speed of an engine for the left outboard motor). However, even in a fault condition in which, for example, the remote controller side ECUs 27, 49 for the left outboard motor are determined to function as if only a single outboard motor is provided, the remote controller side ECU (not shown) for the central outboard motor targets the middle position between the remote control levers 29, 30 or the remote control levers 51, 52, just as in the normal operating condition.

The operations of the first through sixth exclusive use sections 72-77 are realized by executing the programs stored in the ROM 103 using the CPU (not shown) in the embodiment described above. The scope of the invention, however, is not limited to the particular embodiments described herein. A portion of or the whole of the functions of the first through sixth exclusive use sections 72-77 can be realized by hardware so as to make the operations swifter and to stabilize the operations.

In embodiments discussed above, the respective remote controller side ECUs 27, 28, 49, 50 have generally the same construction. It is to be understood that, in additional embodiments, the ECUs 27, 28, 49, 50 may have substantially different construction, but preferably each of the ECUs is configured to be able to perform each of the roles of the other ECUs. Also, preferably each of the ECUs comprises structure to perform ECU role determination consistent with the principles discussed herein.

Although this remote control system and apparatus has been disclosed in the context of certain preferred embodiments and examples, it will be understood by those skilled in the art that the present inventions extend beyond the specifically disclosed embodiments to other alternative embodiments and/or uses of the remote control system and obvious modifications and equivalents thereof. In addition, while a number of variations of the remote control apparatus have been shown and described in detail, other modifications, which are within the scope of this remote control apparatus, will be readily apparent to those of skill in the art based upon this disclosure. It is also contemplated that various combinations or sub-combinations of the specific features and aspects of the embodiments may be made and still fall within the scope of the inventions. Accordingly, it should be understood that various features and aspects of the disclosed embodiments can be combined with or substituted for one another in order to form varying modes of the inventions. Thus, it is intended that the scope of the present inventions herein disclosed should not be limited by the particular disclosed embodiments described above, but should be determined only by a fair reading of the claims.

What is claimed is:

1. A method of operating a remote control system for controlling propulsion units of a watercraft, the watercraft including at least a main cockpit and least a left side propulsion unit and a right side propulsion unit, first and second remote controller side ECUs disposed in the main cockpit, each of the ECUs including at least a central processing unit and plurality of programs stored in a memory, the plurality of programs including at least two exclusive use sections, a first exclusive use section providing a function corresponding to the role of the main cockpit and the left side propulsion unit, the second exclusive use section providing a function corresponding to the role of the main cockpit and the right side propulsion unit, the method comprising:

activating the first ECU;

receiving an input signal with the first ECU;

determining which of the roles should be performed by the first ECU based on the input signal;

reading out the exclusive use section corresponding to the role determined in the determining step, from the plurality of programs in the memory; and executing the exclusive use section determined in the determining step with the central processing unit of the first ECU without executing any of the other exclusive use sections of the programs in the memory, so as to operate the first ECU in the role determined in the determining step.

2. The method according to claim 1, wherein each of the ECUs include an ECU determining section and at least first and second EPROMs, wherein the step of receiving an input signal comprises receiving at least first and second signals, and wherein the method additionally comprises storing first data in the first EPROM representing the first signal and storing second data representing to the second signal in the second EPROM.

3. The method according to claim 2, wherein the step of determining comprises correlating the datum stored in the first and second EPROMs to the role.

4. The method according to claim 1 additionally comprising activating the second ECU, receiving an input signal with the second ECU, determining which of the roles should be performed by the second ECU based on the input signal, and determining if the determined role for the second ECU is the same as the role determined for the first ECU.

5. The method according to claim 4 additionally comprising reading out another exclusive use section that is different than the exclusive use section corresponding to the role determined for the second ECU if the role determined for the second ECU is the same as the role determined for the first ECU.

6. The method according to claim 4, additionally comprising storing the roles determined in the determining step, comparing the stored determined roles with each other, and determining which stored determined role is most frequently stored, wherein the step of reading out another exclusive use section comprises reading out the exclusive use section corresponding to the most frequently stored role.

7. The method according to claim 1 additionally comprising storing the roles determined in the determining step, comparing the stored determined roles with each other, and determining which stored determined role is most frequently stored.

8. The method according to claim 7, additionally comprising determining if the first ECU does not receive a readable signal in the receiving step, and if all of the stored determined roles are different from each other, the first ECU functions as if only a single propulsion unit were associated with the remote control system.

9. A method of operation of a remote control system for controlling at least one propulsion unit of a watercraft, the watercraft including at least one remote controller having at least a first ECU, the first ECU including a plurality of programs stored in a memory, the plurality of programs including at least two exclusive use sections, a first exclusive use section providing a function corresponding to the role of a main cockpit and at least one propulsion unit, the second exclusive use section providing a function corresponding to the role of an auxiliary cockpit and the at least one propulsion unit, the method comprising:

activating the first ECU;

receiving an input signal with the first ECU;

determining which of the roles should be performed by the first ECU based on the input signal;

reading out the exclusive use section corresponding to the role determined in the determining step, from the plurality of programs in the memory; and executing the exclusive use section determined in the determining step with the first ECU without executing any of the other exclusive use sections of the programs in the memory, so as to operate the first ECU in the role determined in the determining step.

10. The method according to claim 9, wherein the first ECU includes an ECU determining section and at least first and second EPROMs, wherein the step of receiving an input signal comprises receiving at least first and second signals, and wherein the method additionally comprises storing first data in the first EPROM representing the first signal and storing second data representing to the second signal in the second EPROM.

11. The method according to claim 10, wherein the step of determining comprises correlating the datum stored in the first and second EPROMs to the role.

12. The method according to claim 9 additionally comprising activating a second ECU including a plurality of programs stored in a memory, the plurality of programs including at least two exclusive use sections, a first exclusive use section providing a function corresponding to the role of a main cockpit and at least one propulsion unit, the second exclusive use section providing a function corresponding to the role of an auxiliary cockpit and the at least one propulsion unit.

13. The method according to claim 12 wherein the method additionally comprises receiving an input signal with the second ECU, determining which of the roles should be performed by the second ECU based on the input signal, and determining if determined role for the second ECU is the same as the role determined for the first ECU.

14. The method according to claim 13 additionally comprising reading out another exclusive use section that is different than the exclusive use section corresponding to the role determined for the second ECU if the role determined for the second ECU is the same as the role determined for the first ECU.

15. The method according to claim 14, additionally comprising storing the roles determined in the determining step, comparing the stored determined roles with each other, and determining which stored determined role is most frequently stored, wherein the step of reading out another exclusive use section comprises reading out the exclusive use section corresponding to the most frequently stored role.

16. The method according to claim 9 additionally comprising storing the roles determined in the determining step, comparing the stored determined roles with each other, and determining which stored determined role is most frequently stored.

17. The method according to claim 16, additionally comprising determining if the first ECU does not receive a readable signal in the receiving step, and if all of the stored determined roles are different from each other, the first ECU functions as if only a single propulsion unit were associated with the remote control system.

18. A method of operation of a remote control system for controlling at least one propulsion unit of a watercraft, the watercraft including at least one remote controller having at least a first ECU, the first ECU including a plurality of programs stored in a memory, the plurality of programs including at least two exclusive use sections, a first exclusive use section providing a function corresponding to the role of a first propulsion unit, the second exclusive use section providing a function corresponding to the role of a second propulsion unit, the method comprising:

activating the first ECU;

receiving an input signal with the first ECU;

determining which of the roles should be performed by the first ECU based on the input signal;

storing the role determined in the determining step;

repeating the activating, receiving, determining and storing steps a plurality of times;

determining which of the roles are stored most frequently; and executing with the first ECU the exclusive use section that corresponds to the role that is determined as being stored most frequently, without executing any of the other exclusive use sections of the programs in the memory.

* * * * *